US006090030A

United States Patent [19]

Rogers

[11] Patent Number: 6,090,030

[45] Date of Patent: Jul. 18, 2000

[54] METHOD AND APPARATUS FOR ASSISTING IN PERFORMING A PAPER MANIPULATING TASK

[76] Inventor: Richard B. Rogers, P.O. Box 1622, West Point, Va. 23181

[21] Appl. No.: 09/162,065

[22] Filed: Sep. 29, 1998

[51] Int. Cl.[7] ..... B31B 1/14; B65H 29/46; B65H 9/12; A47B 11/00

[52] U.S. Cl. ..... 493/363; 493/417; 270/30.07; 270/37; 271/241; 83/468.6; 108/102; 108/137

[58] Field of Search ..... 493/417, 365, 493/363, 405, 395; 270/30.07, 30.05, 58.17, 30.01, 37; 271/241, 271; 269/73; 83/468.7, 468.6, 467.1, 916; 414/222.07; 312/330.1; 108/137, 102

[56] References Cited

U.S. PATENT DOCUMENTS

| | | | |
|---|---|---|---|
| 43,634 | 7/1864 | Brombacher | 83/468.7 |
| D. 197,541 | 2/1964 | Abend et al. . | |
| D. 372,737 | 8/1996 | Herbst et al. . | |
| 2,383,201 | 8/1945 | Kruchten | 83/468.7 |
| 2,679,045 | 5/1954 | Neumann . | |
| 3,131,819 | 5/1964 | Decayet, Jr. . | |
| 4,210,077 | 7/1980 | Lindstrom | 101/123 |
| 4,489,634 | 12/1984 | Volk | 83/471.2 |
| 4,861,015 | 8/1989 | Stearns et al. | 271/213 |
| 5,056,774 | 10/1991 | Kubota et al. | 271/213 |
| 5,069,099 | 12/1991 | Fulton | 83/468.6 |
| 5,147,275 | 9/1992 | Staniszewski | 493/416 |
| 5,171,002 | 12/1992 | Herke et al. | 269/73 |
| 5,301,933 | 4/1994 | Inoue | 269/73 |
| 5,673,604 | 10/1997 | Rigney | 83/468.7 |
| 5,901,954 | 5/1999 | Allmendinger et al. | 271/221 |
| 5,927,213 | 11/1999 | Leday | 108/102 |
| 5,989,173 | 11/1999 | Lugea et al. | 493/405 |

*Primary Examiner*—Brian L. Johnson
*Assistant Examiner*—Matthew Luby
*Attorney, Agent, or Firm*—Everett G. Diederiks, Jr.

[57] ABSTRACT

An apparatus and method for assisting an individual, particularly a physically and/or mentally handicapped person, in performing a paper manipulating task includes a base which supports a paper manipulating unit, such as an electric stapler, hole punch, folding mechanism or the like, as well as a platform. In the most preferred form, the platform is vertically adjustable relative to the base in order to enable positioning the platform at a height commensurate with a paper receiving zone associated with the selected paper manipulating unit. A paper tray, selected from a group of trays depending on the particular paper manipulating task desired to be performed, is provided atop the platform for movement between a paper loading position, wherein one or more sheets of paper are arranged in the tray, and an operating position, wherein the one or more sheets are delivered to the paper manipulating unit. With this arrangement, a compact, generally universal and simple to operate apparatus is provided which can be initially used to train handicapped individuals to perform various paper manipulating tasks and later used by the individuals to perform the tasks in the workplace.

20 Claims, 4 Drawing Sheets

2
6
8
10
11
13
14
17
18
28
29
34
37
59
62
63
69
78
80
84
85
86
87
90
91
94
97
98
99
101
102

2
110
114
109
104
115
- 106 -
111
63
28
51
29
11
21
17
59
66
63
6
14
24
22
52
18
- 8 -
54
62
67
59
63
25
13
10
62
53
62
62
44
34
45
- 39 -
47
69
- 41 -
37
46

METHOD AND APPARATUS FOR ASSISTING IN PERFORMING A PAPER MANIPULATING TASK

BACKGROUND OF THE INVENTION

1. Field of the Invention

The present invention pertains to the art of education and training and, more particularly, to a method and apparatus for assisting an individual in performing certain paper manipulating tasks, such as stapling, hole punching, folding and the like.

2. Discussion of the Prior Art

When performing a paper manipulating task utilizing a device, such as a stapler, hole punch, folding mechanism or the like, it is necessary to initially arrange one or more pieces of paper and then to properly align the paper as it is delivered to the device. Although these paper manipulating tasks generally do not represent any problems for most individuals, such tasks can be difficult, if not heretofore impossible, for certain mentally and/or physically handicapped people.

A fair amount of effort has been expended in recent years directed toward simplifying certain paper handling and manipulating tasks. For instance, some copier models will not only make and collate copies, but can automatically staple the copies as well. On a much simpler level, some electric staplers, hole punch mechanisms and even paper folding devices incorporate paper alignment guides which aid individuals in utilizing the devices. Unfortunately, even with these aids, such devices typically cannot be consistently and efficiently operated by many handicapped individuals. On the other hand, it would be highly desirable to be able to train mentally and/or physically handicapped individuals to perform these types of clerical functions such that these individuals can find employment in the workplace, further contribute to society and enhance their own self-worth in general.

Based on the above, there exists a need in the art for a method and apparatus for assisting handicapped and other individuals in performing various paper handling tasks. More specifically, there exists a need for a compact and preferably portable apparatus which can be used to train handicapped individuals to perform various paper manipulating tasks and then can be later used in the workplace for this purpose.

SUMMARY OF THE INVENTION

The present invention is directed to a method and apparatus for assisting an individual, particularly a mentally and/or physically handicapped individual, in performing one or more paper manipulating tasks. The invention can be used to both train individuals to perform certain paper manipulating tasks and to enable the individuals to consistently repeat the tasks in the workplace.

In the most preferred form of the invention, the apparatus includes a paper support tray mounted for translational movement upon a substantially planar upper surface of a platform. The tray includes one or more placement or alignment aiding elements to assist in properly arranging papers on the tray. The platform has associated therewith a guide arrangement for assuring that the tray can only be shifted relative to the platform along a desired path. More specifically, the tray is movable between a loading position, wherein one or more pieces of paper can be placed on the tray, and an operating position, wherein the papers are delivered to a paper manipulating unit, such as an electric stapler, hole punch, folding mechanism or the like. The platform is preferably vertically adjustable relative to a base such that the apparatus can be readily adjusted for use with various different paper manipulating units, each of which has an associated paper receiving opening or slot which may be vertically offset relative to another type of paper manipulating unit. The base is also used to support the selected paper manipulating unit such that a portable, compact, self-contained and generally universal assembly is provided.

With this arrangement, an individual, handicapped or otherwise, can consistently arrange consecutive sets of paper, ranging from one to many sheets, in a predetermined position on the tray. The tray can then be shifted relative to the platform toward the paper manipulating unit so that the paper(s) can be directly acted upon by the selected paper manipulating unit. Depending upon the particular manipulating unit being used, a corresponding paper support tray would be selected, with the selected paper support tray being specifically designed to cooperate with the preselected manipulating unit.

Additional objects, features and advantages of the present invention will become more readily apparent from the following detailed description of a preferred embodiment thereof, when taken in conjunction with the drawings wherein like reference numerals refer to corresponding parts in the several views.

DETAILED DESCRIPTION OF THE INVENTION

Figure 1:
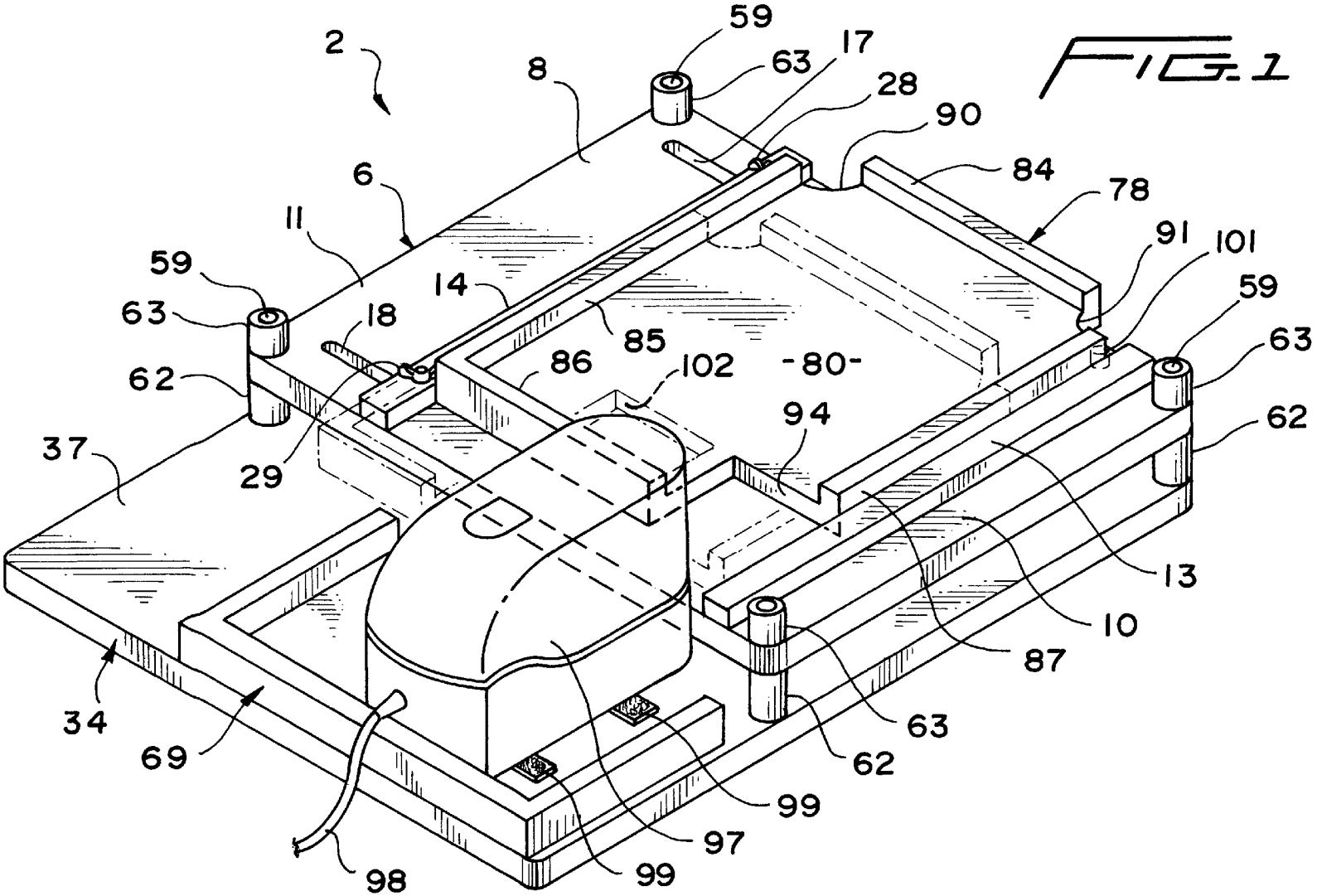
FIG. 1 is a perspective view of the apparatus of the present invention being used in connection with performing stapling operations.
Figure 3:
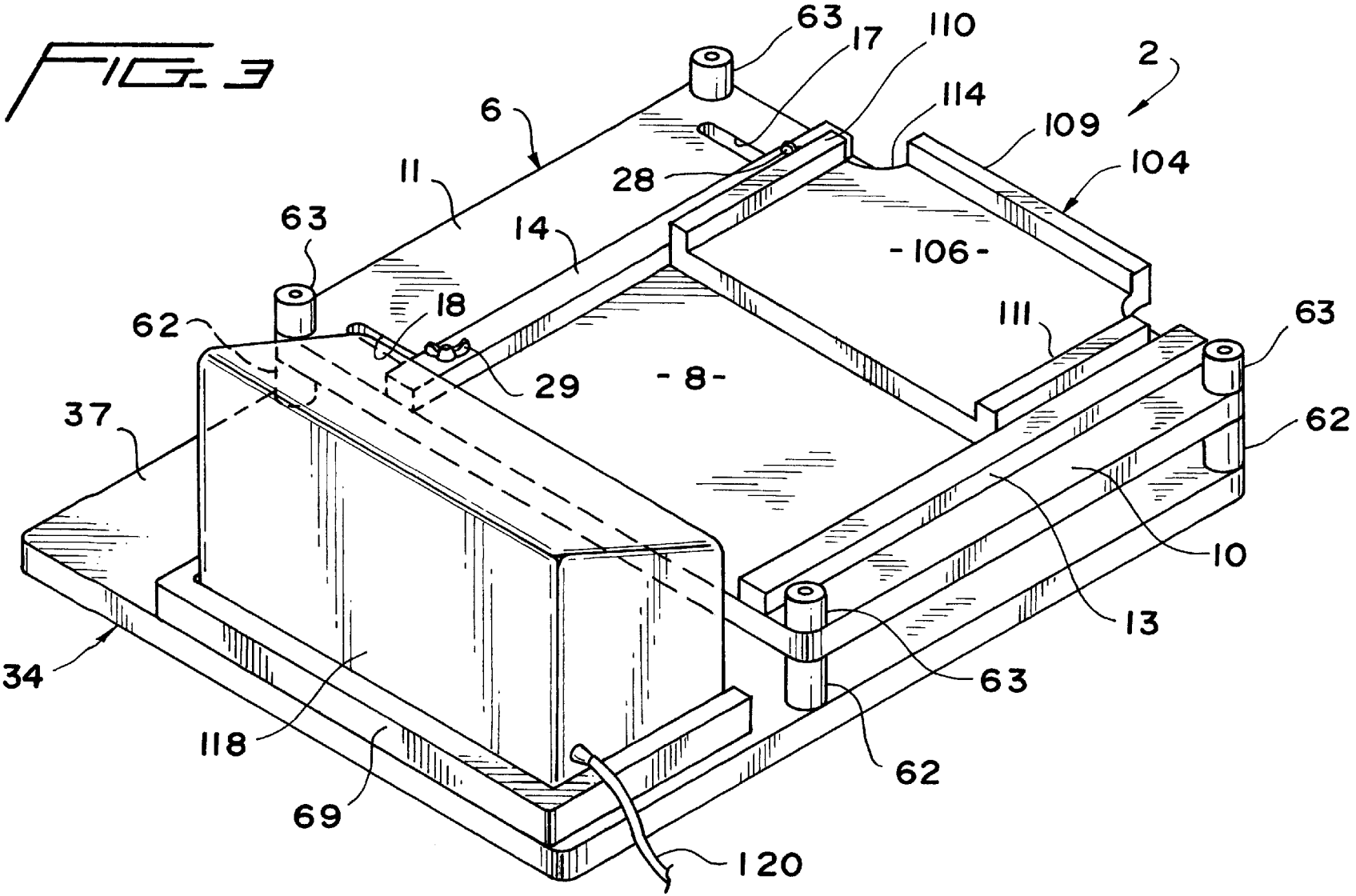
FIG. 3 is a perspective view of the apparatus shown for use in connection with an electric paper folding machine.
Figure 4:
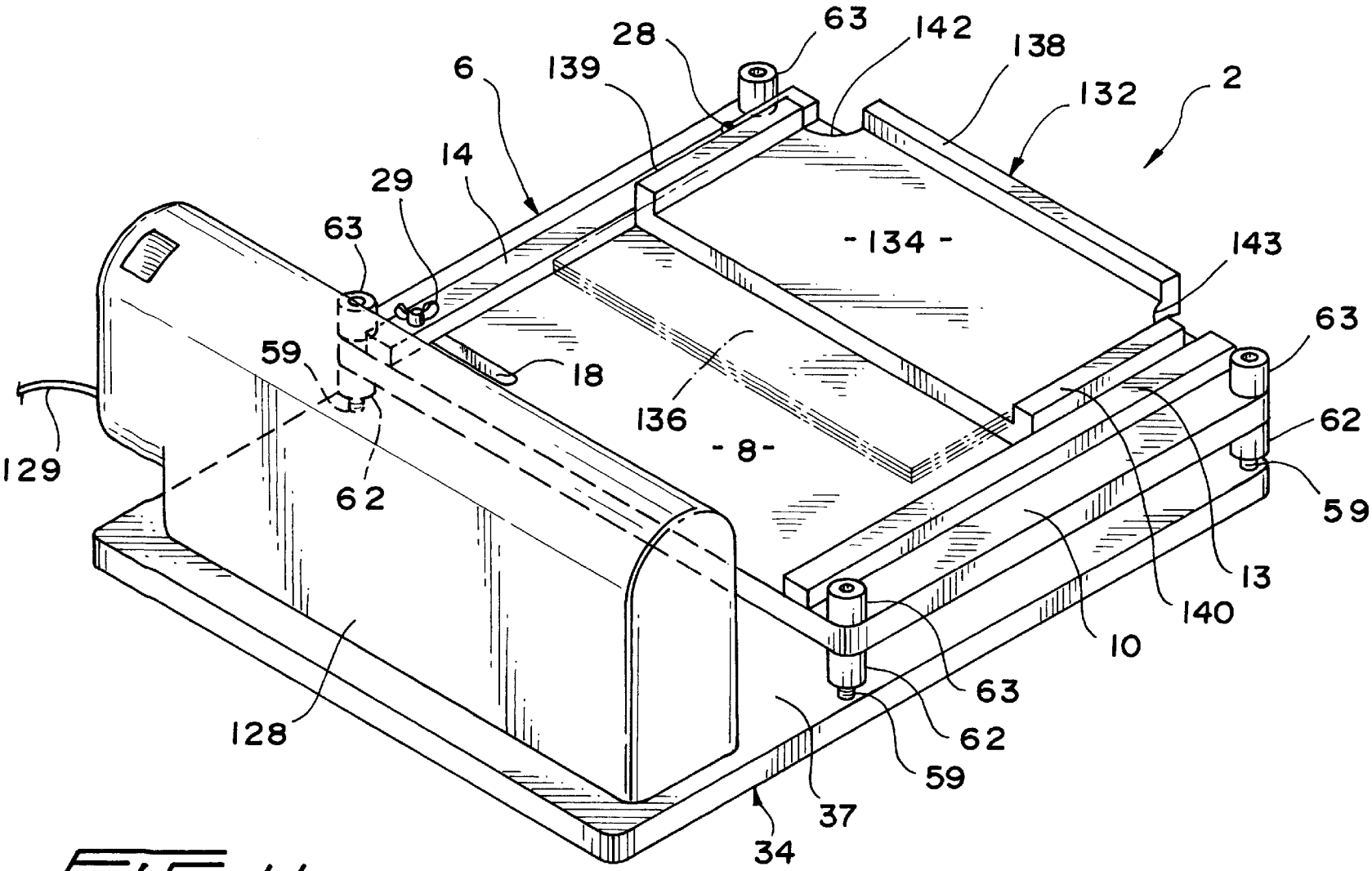
FIG. 4 is a perspective view of the apparatus being used in combination with an electric multi-hole punch mechanism.

With reference to the drawings, an apparatus for assisting an individual in performing a paper manipulating task in accordance with the present invention is generally indicated at 2. In the most preferred form of the invention, apparatus 2 can be readily adapted for use in performing various paper manipulating tasks, including stapling, hole punching and folding as generally represented in FIGS. 1, 3 and 4 respectively. Initially, reference will be made to FIGS. 1 and 2 in describing the preferred construction and general operation of apparatus 2. Thereafter, FIGS. 3 and 4 will be referenced to further illustrate the universal nature of apparatus 2 and the ease in which apparatus 2 can be converted for use in performing additional paper manipulating tasks.

Figure 2:
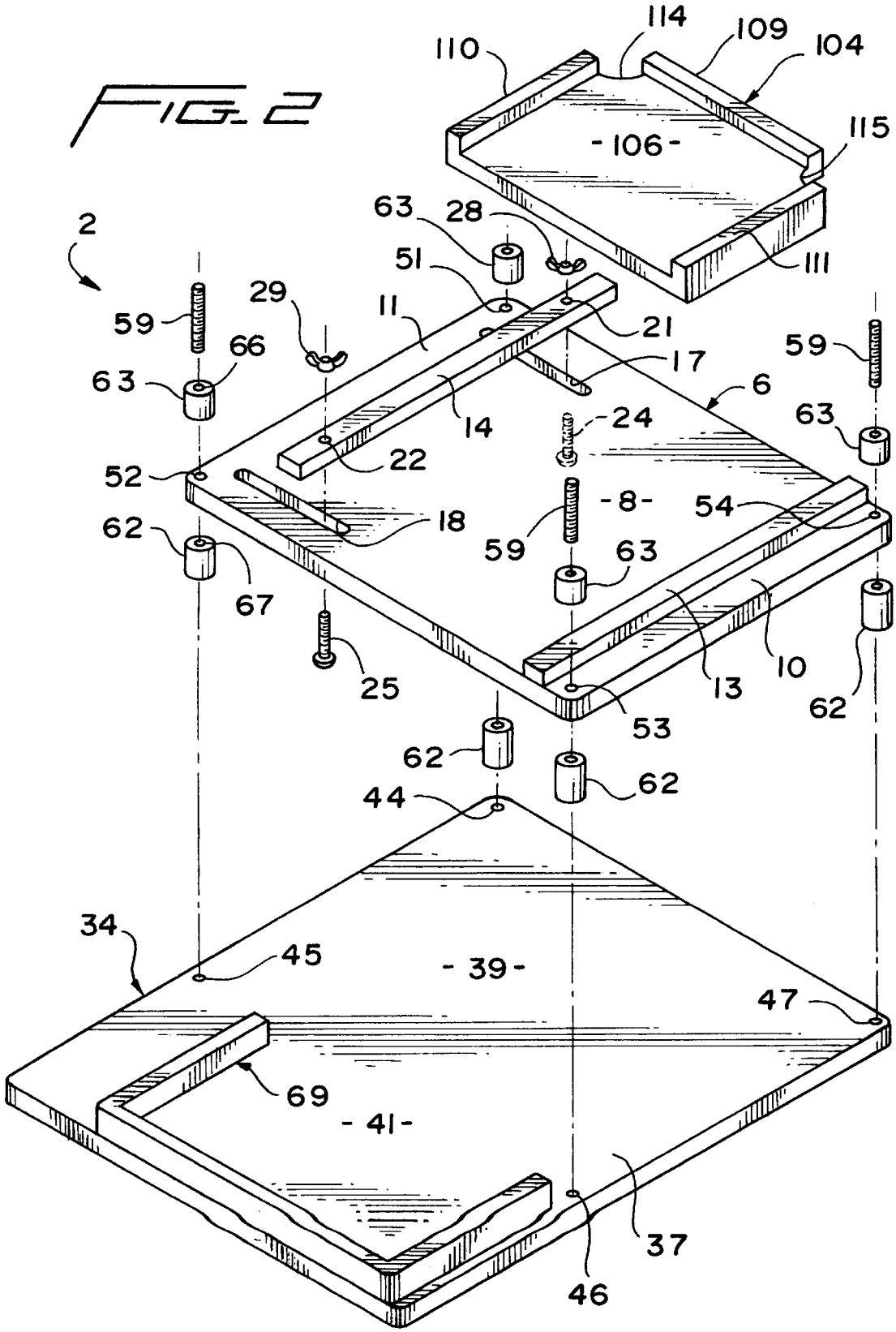
FIG. 2 is an exploded view of the apparatus shown in FIG. 1 illustrated with a second type of paper support tray.

As shown in FIGS. 1 and 2, apparatus 2 includes a platform 6 having a generally planar upper surface 8 and lateral edge portions 10 and 11. Arranged adjacent lateral edge portions 10 and 11 are respective longitudinally extending guide rails 13 and 14. In the preferred embodiment, guide rail 13 is fixedly secured or integrally formed with platform 6. At lateral edge portion 11, platform 6 is provided with a pair of longitudinally spaced and laterally extending slots 17 and 18. Guide rail 14 is formed with a pair of bores 21 and 22 which are spaced longitudinally a distance commensurate to the spacing between slots 17 and 18. With this arrangement, guide rail 14 can be adjustably secured atop platform 6, preferably through the use of a system which enables guide rail 14 to be laterally shifted relative to guide rail 13 in an easy and convenient manner. In the preferred embodiment shown, threaded mechanical fasteners 24 and 25 are used in combination with wing nuts 28 and 29 to selectively secure guide rail 14 in a desired position. More specifically, each mechanical fastener 24, 25 extends freely through both a respective slot 17, 18 and a respective bore 21, 22 and has secured thereto a wing nut 28, 29. In an alternative form (not shown), fasteners 24 and 25 can be fixed to and interconnected by a shiftable rail, similar to but preferably shorter than guide rail 14, which would be arranged below platform 6. In any event, loosening of wing nuts 28 and 29 enables guide rail 14 to be laterally shifted relative to platform 6 within a range defined by slots 17 and 18. Therefore, the distance between guide rails 13 and 14 can be varied for reasons which will become more fully apparent below.

In the most preferred form of the invention, apparatus 2 also includes a base 34 having an upper surface 37 including a front section 39 and a rear section 41. Extending within base 34, forward of rear section 41, is a plurality of spaced apertures 44–47. Apertures 44–47 are aligned with holes 51–54 shown provided at corner portions of platform 6. Each hole 51–54 is adapted to freely receive a respective threaded stud 59 which extends through one of holes 51–54 and is threadably secured within a respective aperture 44–47. Each threaded stud 59 also preferably extends through a pair of spacer elements 62 and 63. More specifically, spacer elements 62 and 63 include respective, threaded through holes 66 and 67 which become threaded upon stud 59. Therefore, each stud 59 is secured to base 34 within a respective aperture 44–47, spacer element 62 is threadably secured on the stud 59, the stud 59 freely extends through a respective hole 51–54 and spacer element 63 is threaded atop stud 59.

With this interconnection between base 34 and platform 6, platform 6 can be vertically shifted relative to base 34 in an easy and convenient manner. More specifically, each spacer element 63 can be rotated so as to be shifted along the axis defined by respective stud 59, followed by a corresponding rotation of spacer element 62 in order to raise platform 6 relative to base 34, and the reverse operation can be performed to lower platform 6 relative to base 34. The rear section 41 of base 34 is preferably provided with a mounting frame generally indicated at 69. In the preferred embodiment shown, mounting frame 69 generally constitutes a three-sided frame that projects upward from upper surface 37 and which opens toward platform 6.

Specific reference will now be made to FIG. 1 in describing additional structure of apparatus 2 and a first preferred use thereof. As clearly shown in FIG. 1, apparatus 2 further includes a first paper support tray 78 that defines a paper receiving zone 80 around which extend various upstanding, paper alignment aiding edge walls 84–87. In the preferred form, first paper support tray 78 would be sized such that paper receiving zone 80 equals the surface area of a piece of paper received therein. Therefore, if letter-sized paper is utilized, paper receiving zone 80 would generally be sized to 8½×11 inches. In the most preferred form shown, upstanding edge walls 85 and 86 are generally continuous, wherein upstanding edge walls 84 and 85 are spaced by an arcuate corner opening 90, upstanding edge walls 84 and 87 are spaced by an arcuate corner opening 91 and upstanding edge walls 86 and 87 define therebetween a cut-out section 94. In this form, arcuate corner openings 90 and 91 are provided to enhance the gripping of paper placed within receiving zone 80 such that the papers can be easily removed when desired. The particular lengths, widths and heights associated with upstanding edge walls 84–87 can vary in accordance with the present invention. In general, the heights of upstanding edge walls of 84–87 are preferably slightly greater than the maximum number of sheets of paper adapted to be placed within paper receiving zone 80 within any given time.

As clearly shown in FIG. 1, upstanding edge walls 85 and 87 are generally arranged against guide rails 14 and 13 respectively. With this arrangement, first paper support tray 78 can be readily translated in the longitudinal direction relative to platform 6 and base 34, with rails 13 and 14 guiding first paper support tray 78 along a generally linear path between a loading position shown in solid in FIG. 1 and an operating position shown in phantom wherein first paper support tray 78 has been shifted toward a paper manipulating unit 97.

In this embodiment, paper manipulating unit 97 constitutes an electronic stapler having an associated power cord 98. As shown, stapler 97 is supported upon base 34, generally within the confines of mounting frame 69. The particular manner in which stapler 97 is mounted atop base 34 can vary greatly in accordance with the present invention. However, it is preferable to have stapler 97 fixed so that it does not shift relative to base 34 during operation of apparatus 2. In one simple attachment form, Velcro® strips, as indicated at 99, are used to attach stapler 97 to upper surface 37 of base 34. As shown, cut-out section 94 is provided at a corner of first paper support tray 78. It is juxtaposed this position that stapler 97 is positioned. With this arrangement, first paper support tray 78 would initially be placed in the loading position, where papers would be placed within receiving zone 80 as defined by upstanding edge walls 84–87, and then first paper support tray 78 would be shifted relative to platform 6 and base 34 to the operating position wherein the papers would be automatically received within and acted upon by stapler 97. Thereafter, first paper support tray 78 would be retraced and the papers removed. This sequence would then be repeated for each set of papers to be stapled.

Although not shown in FIG. 2, FIG. 1 illustrates that it is preferable to limit the permissible travel of first paper support tray 78 away from stapler 97. In the preferred embodiment shown, at least one upstanding knob 101 is secured atop platform 6 and abuts first paper support tray 78 for this purpose. At this point, it should be realized that cut-out section 94 can be located in various places along the forward edge of first paper support tray 78, depending upon the position in which it is desired to staple the papers. Cut-out section 94 is shown to be provided in a corner of first paper support tray 78 as this location is considered to be the most common location for stapling papers. However, it may be desirable to staple papers at other locations wherein the cut-out section would be repositioned, such as to a central position as indicated in phantom at 102.

FIG. 3 illustrates another form for apparatus 2 wherein first paper support tray 78 has merely been replaced by a second paper support tray 104, which is also shown in FIG. 2. In general, second paper support tray 104 includes a paper receiving zone 106 having a width corresponding to that of first paper support tray 78, but which is shorter in length. Second paper support tray 104 also only is shown to include three upstanding edge walls 109–111 and includes arcuate corner openings 114 and 115 which, of course, are similar to arcuate corner openings 90 and 91 discussed above. Second paper support tray 104 is made shorter in this embodiment since apparatus 2 is used in connection with a second paper manipulating unit 118 that preferably constitutes a paper folding mechanism. Here, folding mechanism 118 is also shown to be an electric unit and therefore has an associated power cord 120. Therefore, instead of receiving simply a corner of the papers in a manner similar to stapler 97, folding mechanism 118 is adapted to receive an entire top or bottom portion of the papers placed within second support tray 104. Correspondingly, instead of being provided with a cut-out section similar to that indicated at 94 for first paper support tray 78, second paper support tray 104 is broadly considered to have an entire cut-out rear portion. However, a cut-out section, similar to either of cut-out sections 94 or 102, could still be formed in second paper support tray 104 if it is also desired to use paper support tray 104 in a subsequent stapling operation for the folded paper. Aside from these minor differences, the structure and operation of apparatus 2 remains substantially the same.

It should be noted that folding mechanism 118 is arranged to be snugly received within mounting frame 69 and to generally abut an edge of platform 6 to limit any relative shifting between folding mechanism 118 and either platform 6 or base 34. Once folding mechanism 118 is properly positioned and supplied with power, papers can be manually inserted within receiving zone 106 while second paper support tray 104 is in its retracted or loading position and then second paper support tray 104 can be shifted toward folding mechanism 118 wherein the papers are automatically received, folded and ejected back unto second paper support tray 104. Thereafter, second paper support tray 104 is withdrawn for removal of the papers and insertion of another set of one or more papers.

FIG. 4 shows apparatus 2 adapted for use with a third paper manipulating unit 128 that constitutes a multi-hole punch. Again, it is preferable to have an electric hole punch 128 and therefore a power cord 129 is generally illustrated. It should be initially noted that mounting frame 69 is absent from atop base 34 in this figure. In general, mounting frame 69 is considered ancillary structure and FIG. 4 merely illustrates that this structure is not necessary to the general invention. This figure also illustrates why platform 6 is preferably vertically adjustable relative to base 34. Here, the slot associated with multi-hole punch 128 is vertically higher than the corresponding paper receiving slots associated with stapler 97 and folding mechanism 118. Therefore, spacer elements 62 and 63 have been rotated upon their respective studs 58 to raise platform 6 relative to base 34 in the manner described above.

FIG. 4 also shows apparatus 2 for use with a third paper support tray 132 which is substantially identical in construction to second paper support tray 104, but which is laterally elongated and somewhat shorter in the embodiment shown in order that the sides of papers can be delivered to multi-hole punch 128. In order to enable third paper support tray 132 to be guidably supported for movement between its loading and operating positions, it should be noted that guide rail 14 has been shifted laterally relative to guide rail 13 in a manner also described above. In any event, third paper support tray 132 includes a receiving area 134 within which is to be arranged papers 136. Receiving area 134 is at least partially defined by upstanding edge walls 138–140 between which are arranged arcuate corner openings 142 and 143. In general, one or more papers 136 are arranged on third paper support tray 132 and then third paper support tray 132 is manually shifted such that the papers 136 are received within third paper manipulating unit 128 and holes are formed therein.

Based on the above, it should be readily apparent that apparatus 2 is constructed to be generally universal in that it can be utilized to perform various paper manipulating tasks utilizing readily, commercially available paper manipulating units. However, apparatus 2 should not be considered to be limited solely for use with a stapler 97, a paper folding mechanism 118 or a multi-hole punch 128, but rather can also be utilized with other paper manipulating units including binding machines. In any event, apparatus 2 can be easily adjusted, with platform 6 moving vertically relative to base 34 and guide rail 14 being shifted relative to guide rail 13, such that apparatus 2 can easily accommodate the desired paper manipulating function. Also, due to the relatively simple manner in which apparatus 2 is operated, most individuals, including many physically and/or mentally handicapped persons, can be easily taught to perform repetitive paper manipulating tasks, with this training enabling these individuals, who might not otherwise be adept in carrying out these tasks in the workplace, to obtain productive employment in this field.

Although described with respect to preferred embodiments of the present invention, it should be readily apparent that various changes and/or modifications can be made to apparatus 2 without departing from the spirit of the invention. For example, platform 6 is shown and disclosed as being vertically adjustable relative to base 34 in order that apparatus 2 can be utilized with various paper manipulating units. However, if apparatus 2 is to be used with a dedicated paper manipulating unit, then this vertical adjustable feature is not needed. In fact, depending upon the height of the paper receiving slot associated with the selected paper manipulating unit, platform 6 can also function as the base or could simply be used without base 34. Even if platform 6 is vertically adjustable relative to base 34, various other types of vertical adjusting assemblies and/or mechanisms could be readily utilized to perform this function without departing from the invention. In addition, the particular manner in which the paper support trays are guided for shifting relative to platform 6 can also vary in accordance with the invention. For example, instead of providing guide rails 13 and 14, a dove-tail type tongue and groove system could be provided between a selective one of the support trays and the platform such that no lateral adjustment of the guide arrangement would be required when switching the trays. It should also be realized that the referenced planar upper surface 8 for platform 6 may only need to be present in a zone directly adjacent to the selected paper manipulating unit to assure proper alignment and feeding of the paper. Therefore, platform 6 could even have an arcuate portion if used in conjunction with a flexible or pliable paper support tray. Furthermore, as indicated above, the inclusion of mounting frame 69 is optional and other types of generally universal mounting arrangements could also be readily utilized. Finally, it should be realized that apparatus 2 could be made from various materials, including wood and plastic. Therefore, in general, the above description is intended to be illustrative rather than restrictive and the invention is only intended to be limited by the scope of the following claims.

I claim:

1. An apparatus for assisting an individual in performing a paper manipulating task comprising:

a platform including a substantially planar upper surface; and a support tray for receiving at least one piece of paper, with the support tray being mounted for translational movement upon the upper surface of the platform between a loading position, wherein the support tray receives the at least one piece of paper, and an operating position, wherein the at least one piece of paper is delivered upon the support tray to a paper manipulating unit, said support tray including a lower surface portion, which is arranged atop the upper surface of the platform, and an upper surface portion adapted to receive the at least one piece of paper, with the upper surface portion having an associated area which is less than that of the at least one piece of paper to be placed thereon, wherein a portion of the at least one piece of paper placed on the support tray will extend off the support tray, with the portion of the at least one piece of paper being in alignment with the paper manipulating unit.

2. The apparatus according to claim 1, wherein the support tray includes a cut-out portion at which the at least one piece of paper extends off the support tray.

3. The apparatus according to claim 1, further including at least one paper alignment aiding element extending from the upper surface portion of the support tray.

4. The apparatus according to claim 3, wherein the at least one paper alignment aiding element extends along three circumferentially consecutive sides of the at least one piece of paper.

5. The apparatus according to claim 1, further comprising: means for guiding the support tray during the translational movement between the loading and operating positions.

6. The apparatus according to claim 5, wherein the apparatus has an associated longitudinal axis extending in a direction to and from the loading and operating positions and a lateral axis which extends substantially perpendicular to the longitudinal axis, said guiding means comprising a pair of laterally spaced and longitudinally extending rails attached to the platform at laterally spaced locations, with the support tray being arranged between the rails for movement between the loading and operating positions.

7. The apparatus according to claim 6, wherein at least one of the rails is adjustable laterally relative to the platform.

8. The apparatus according to claim 7, wherein the platform is formed with a pair of longitudinally spaced and laterally extending slots, with the at least one of the rails being adjustably attached to the platform for movement along the slots.

9. The apparatus according to claim 1, further comprising: a base upon which the platform is mounted.

10. The apparatus according to claim 9, further comprising; means for vertically adjusting the platform relative to the base.

11. The apparatus according to claim 9, wherein the base includes a first zone over which the platform is positioned and a second zone adapted to support a paper manipulating unit.

12. The apparatus according to claim 11, further comprising: a mounting frame provided in the second zone of the base for use in locating the paper manipulating unit relative to the base.

13. The apparatus according to claim 9, further comprising a paper manipulating unit arranged on the base, with the support tray approaching the paper manipulating unit as the support tray is shifted from the loading position to the operating position.

14. The apparatus according to claim 13, wherein the paper manipulating unit comprises a stapler.

15. The apparatus according to claim 13, wherein the paper manipulating unit comprises a hole punch.

16. The apparatus according to claim 13, wherein the paper manipulating unit comprises a paper folding mechanism.

17. A method of assisting an individual in performing a paper manipulating task comprising:

arranging a paper support tray, which is slidably supported upon a platform for translational movement relative to the platform, in a paper loading position;

placing at least one piece of paper in a receiving area of the support tray with a portion of the at least one piece of paper extending off the support tray; and shifting the support tray, relative to the platform, to an operating position, wherein the at least one piece of paper is delivered to a paper manipulating unit and the portion of the at least one piece of paper is directed into the paper manipulating unit.

18. The method according to claim 17, further comprising: guiding the support tray for movement along the platform between the loading and operating positions.

19. The method according to claim 17, further comprising: selecting the support tray from a group of support trays in dependence upon the paper manipulating unit.

20. The method according to claim 17, further comprising: vertically adjusting the platform upon a paper manipulating unit supporting base.

* * * * *